United States Patent [19]

Gatt

[11] Patent Number: 4,944,398

[45] Date of Patent: Jul. 31, 1990

[54] STACKABLE NESTABLE TRAY WITH CENTRAL WEIGHT BEARING HUB

[75] Inventor: Edward W. Gatt, Richmond, Mich.

[73] Assignee: Chrysler Corporation, Highland Park, Mich.

[21] Appl. No.: 401,678

[22] Filed: Sep. 1, 1989

[51] Int. Cl.[5] ..... B65D 21/04

[52] U.S. Cl. ..... 206/507; 206/303; 206/389; 206/505; 206/564

[58] Field of Search ..... 206/507, 505, 503, 562, 206/564, 408, 389, 303

[56] References Cited

U.S. PATENT DOCUMENTS

| | | | |
|---|---|---|---|
| 3,657,900 | 4/1972 | Bowser | 206/408 |
| 3,685,646 | 8/1972 | Sy | 206/408 |
| 3,756,462 | 9/1973 | Cain | 206/503 |
| 3,819,847 | 6/1974 | Charles | 206/303 |
| 3,883,037 | 5/1975 | Seiller | 206/507 |
| 4,089,414 | 5/1978 | Sandor | 206/303 |
| 4,158,408 | 6/1979 | Thiessen | 206/564 |
| 4,201,301 | 5/1980 | Aggio | 206/507 |
| 4,311,237 | 1/1982 | Hayes | 206/503 |
| 4,386,700 | 6/1983 | Deaton | 206/507 |
| 4,457,429 | 7/1984 | Huber | 206/408 |
| 4,522,301 | 6/1985 | Ajmera | 206/507 |
| 4,643,310 | 2/1987 | Deaton | 206/507 |
| 4,664,260 | 5/1987 | Stokes | 206/408 |
| 4,703,857 | 11/1987 | Jahen | 206/503 |
| 4,722,440 | 2/1988 | Johnston | 206/564 |

*Primary Examiner*—Stephen Marcus
*Assistant Examiner*—S. Castellano
*Attorney, Agent, or Firm*—Edward A. Craig

[57] ABSTRACT

A stackable and nestable tray for shipping of weather stripping. The tray has a central weight bearing hub which also acts as a stop to pervent weather stripping which is coiled about the hub from shifting in a manner which would damage the weather strip. The tray has a generally rounded body portion which has a bottom wall and an upstanding side wall. A series of radially inwardly extending step-like protrusion are formed on the side wall with corresponding inwardly extending indentations on the opposite side of the side wall. The hub portion is hollow and includes a series of hollow radially outwardly extending protrusions with surfaces extending between the corresponding outwardly extending indentations in the hollow underside. The trays will stack one upon another in a first position and will nest into each other for return shipping when rotated to a second position.

6 Claims, 3 Drawing Sheets

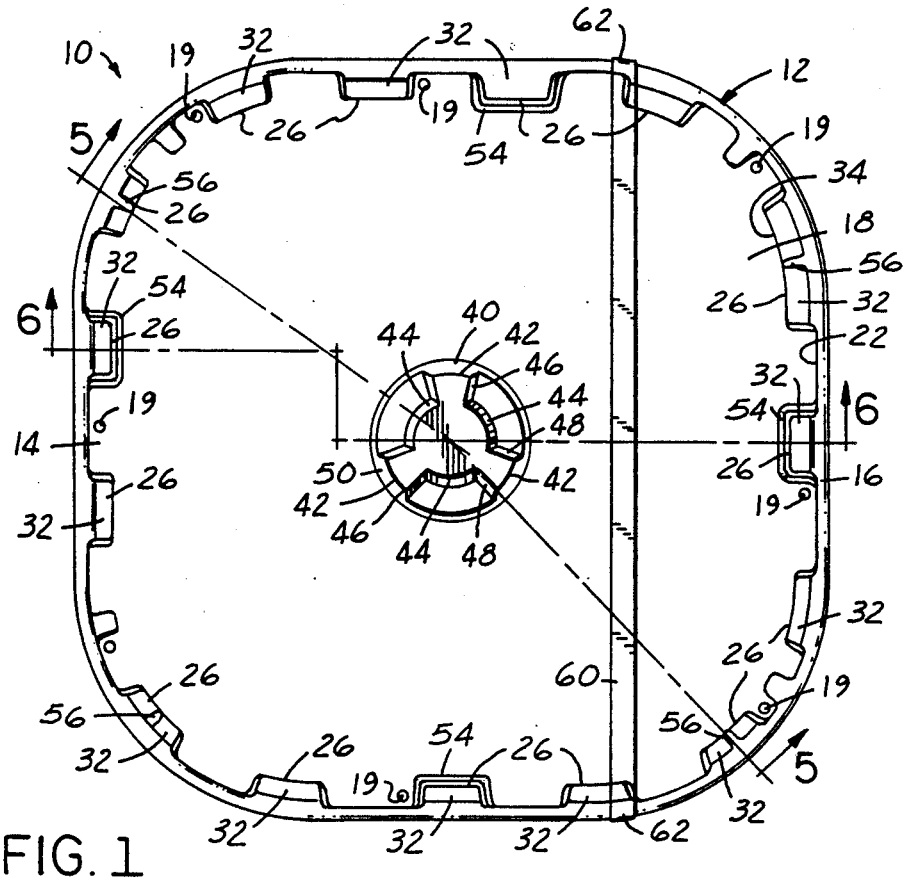
FIG. 1
FIG. 2
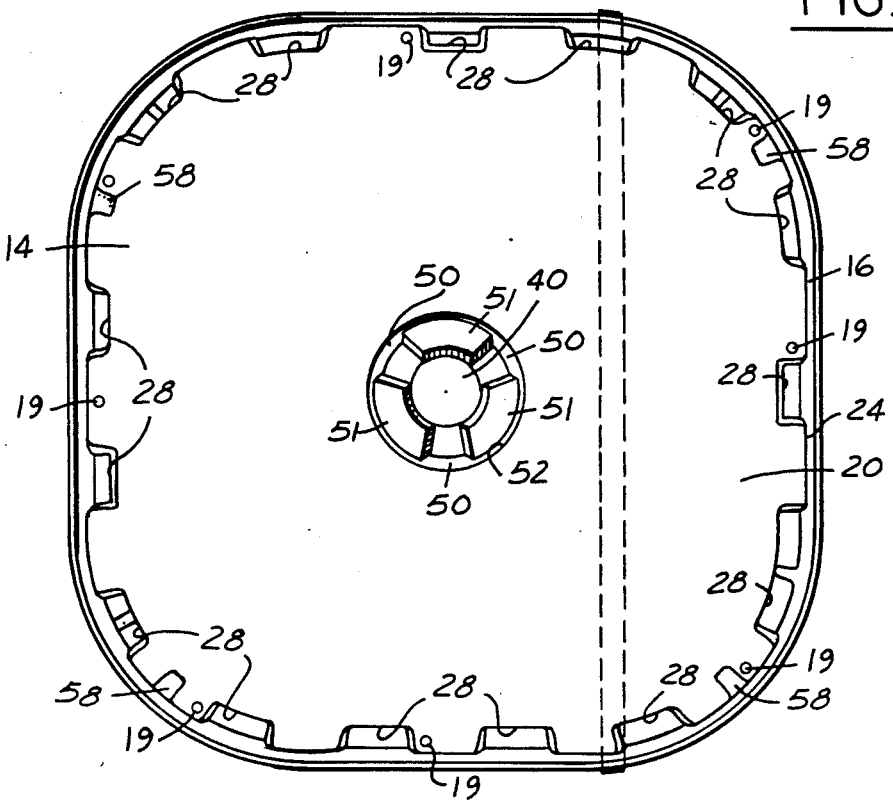

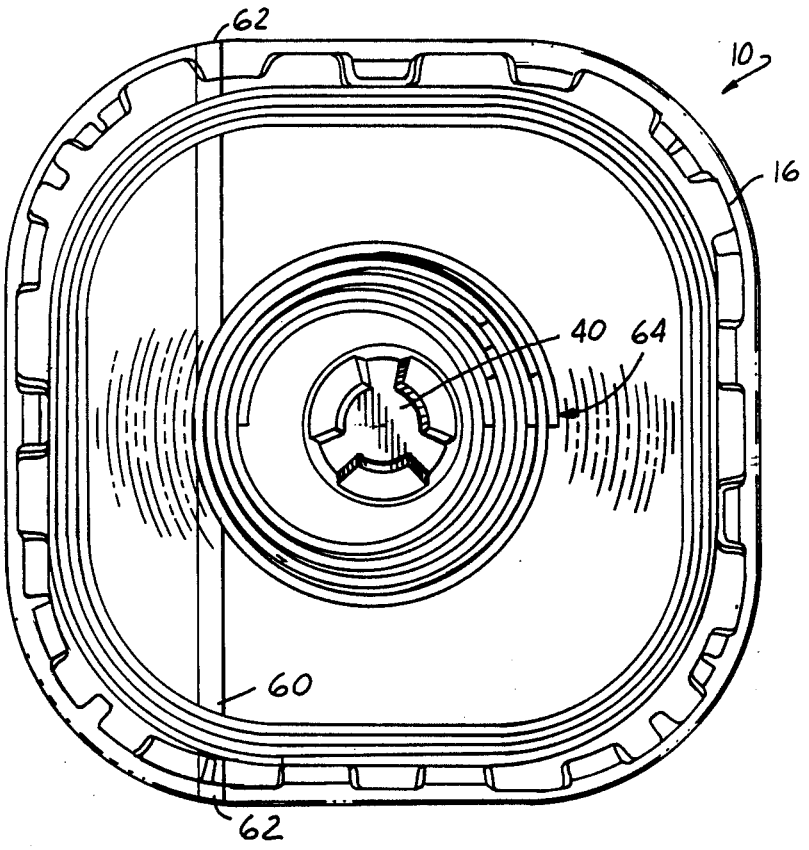
FIG.3
FIG.4
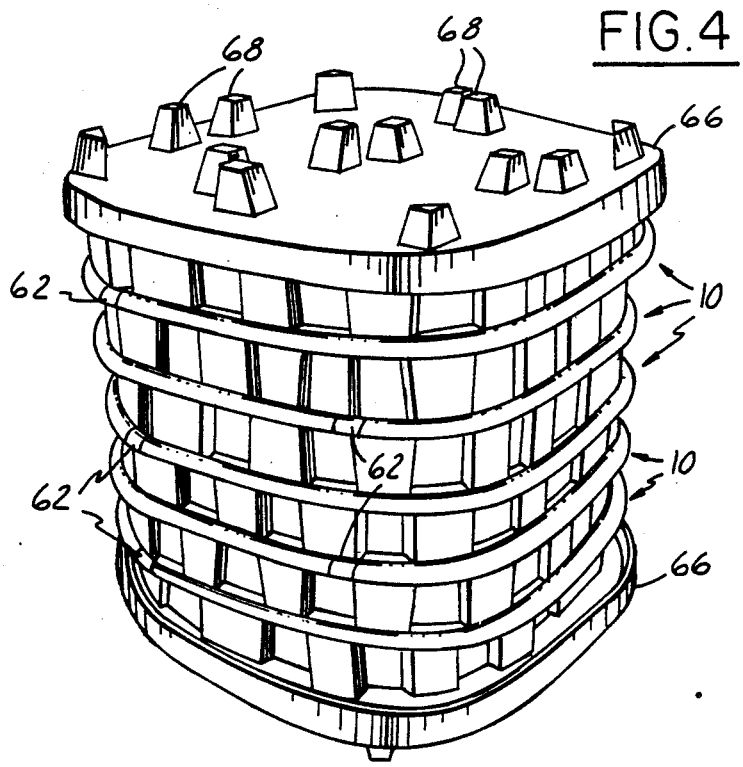

STACKABLE NESTABLE TRAY WITH CENTRAL WEIGHT BEARING HUB

BACKGROUND OF THE INVENTION

1. Field of the Invention

This invention relates to a nestable and stackable tray for shipping of coiled weather stripping and the like.

2. Prior Art

In modern manufacturing, it is common practice to assemble completed units at a single location from various parts and components which are shipped to the assembly location from other locations. The parts and components are normally fabricated in facilities remote from the assembly location and shipped to the assembly location in various types of containers, many of which are disposable. Such disposable containers are fabricated from cardboard and low-grade wood, and while adequate for their intended purpose they have presented serious disposal problems at assembly plants as they are costly to handle, store and transport for disposal.

In the past, weather stripping was coiled on a tray or in a box for shipping. During shipping the weather strips tended to shift and move about. The weather stripping, because of this shifting, was sometimes damaged by kinking or severe bending. The bulb portion of the weather strip is particularly sensitive to damage because of severe bending or kinking of the weather strip during shipping. Such damage can cause problems in sealing in the final automobile if the damaged weather strip remains undetected. If the damaged weather strip is detected the weather strip must be discarded. Thus, damage of weather strip during shipping has resulted in wasted materials and potential problems in use of the weather strip in the final application. Additionally, because of the weight of the coiled pieces of weather strip and the shifting caused thereby, the entire container would have to be reinforced in order to provide for any possible redistributions of weight during shipping.

Thus, in recent years there has become a need to reduce and avoid the waste caused by throwaway containers by providing reusable shipping containers. Additionally, it has been a goal to provide a shipping tray for weather stripping which will reduce the losses of weather stripping due to damage during shipping.

Reusable shipping containers can cause the further problem in that they must be return shipped from the assembly facility to the parts production facility. Thus, it has also been a goal in the art to provide a reusable tray which can be utilized to ship weather stripping and the like and which can be thereafter easily and compactly reshipped to the point of origin for reuse.

In recent years stackable and nestable shipping trays have been utilized as reusable shipping containers. Such trays may be advantageously stacked in a configuration for containing parts therein during shipping and which will nest inside one another for saving space during return shipment of the trays to the point of origin. However, up to the time of the present invention such a tray has not been provided for shipping of weather stripping and the like.

SUMMARY OF THE INVENTION

In accordance with the present invention, a tray for transporting coiled weather stripping is provided. The tray includes a generally rounded body portion which has a bottom wall and an upstanding continuous side wall around the periphery of the bottom wall. The bottom wall includes a top surface and a bottom surface and the side wall has an inner surface and an outer surface. The side wall includes a plurality of spaced radially inwardly extending step-like protrusions on the inner surface thereof. The protrusions extend into the side wall such that corresponding radially inwardly extending indentations are formed on the outer surface of the side wall. The side wall extends vertically above the inwardly extending step-like protrusions and the inwardly extending protrusions include upper surfaces defining a horizontally co-planar surface.

A central hub portion extends from the bottom wall in an up-standing direction and is hollow in cross-section such that it opens inwardly from the bottom surface of the tray. The central hub includes a plurality of radially outwardly extending hub protrusions which provide in the hollow underside of the hub a corresponding plurality hub and radially outwardly extending indentations with horizontally extending surfaces therebetween. Weather stripping is coiled about the hub in the space between the hub and the side wall. The hub acts as a stop to help retain the weather stripping in its coiled orientation to reduce the possibility of damage to the weather stripping due to lateral movement during shipping.

The tray is stackable with a tray of like configuration in a first position wherein portions of the bottom wall between the inwardly extending protrusions rest on the upper surfaces of the step-like inwardly extending protrusions of a tray of like configuration. Additionally, in the stacked position the horizontally extending surfaces of the hollow portion of the hub of one tray rest on the radially outwardly extending protrusions of another tray of like configuration. The weight contained in the tray is distributed during stacking between the hub and the plurality of inwardly extending protrusions of the side wall. The trays are nestable when rotated to a second position wherein the plurality of radially inwardly extending protrusions of the inner surface of the trays nest into the plurality of radially inwardly extending indentations of the outer surface of the like tray. In this position the plurality of radially outwardly extending hub protrusions nest into the plurality of radially outwardly extending indentations of the hollow portion of the hub of the tray of like configuration.

Other advantages of the present invention will be readily appreciated as same becomes better understood by reference to the following description when considered in connection with the accompanying drawings.

DESCRIPTION OF THE DRAWINGS

FIG. 1 is a top view of a tray made in accordance with the teachings of the present invention;

FIG. 2 is a bottom view of a tray made in accordance with the teachings of the present invention;

FIG. 3 is a view similar to FIG. 1 showing the coiling of weather stripping in a tray made in accordance with the teachings of the present invention;

FIG. 4 is a perspective view showing a series of stacked trays including a pallet/lid combination on either side thereof;

BRIEF DESCRIPTION OF A PREFERRED EMBODIMENT

Figure 5:
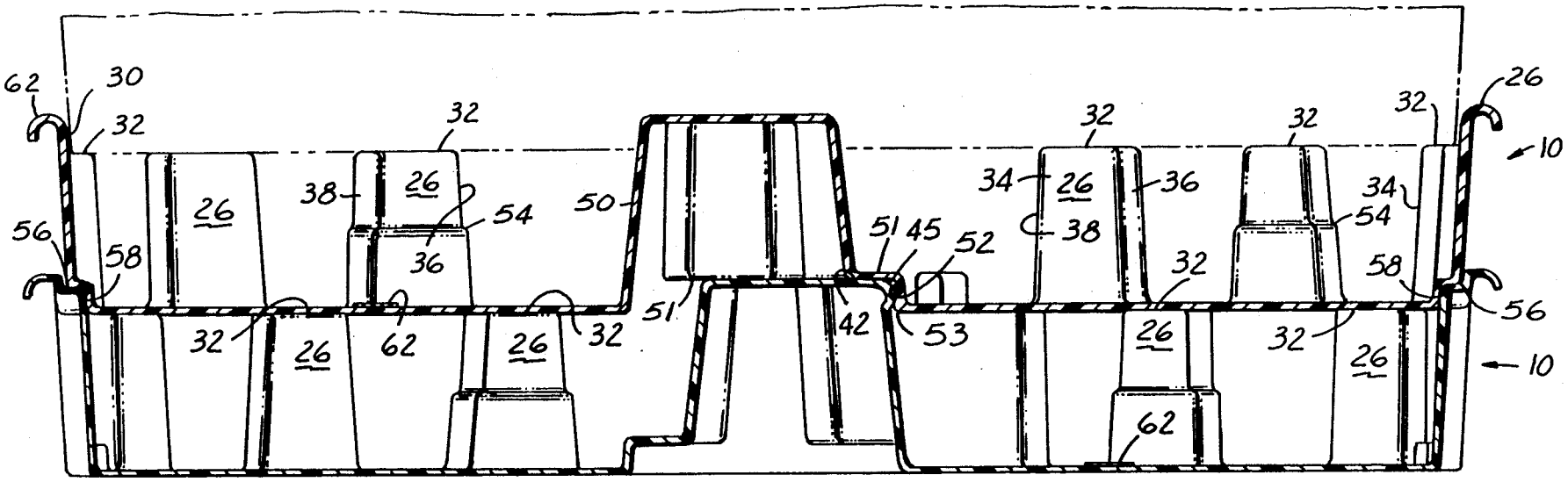
FIG. 5 is a sectional view taken along the lines 5—5 of FIG. 1 showing a pair of trays made in accordance with the teachings of the present invention in the stacked position.

Referring now to the drawings, in accordance with the present invention there is provided a stackable and nestable tray 10 for shipping of weather stripping from a manufacturing location to an assembly plant. The tray has a generally rounded body portion 12. Rounded body portion 12 includes a bottom wall 14 and an upstanding side wall 16. The bottom wall 14 includes a top surface 18 and a bottom surface 20. The side wall 16 includes an inner surface 22 and an outer surface 24. Bottom wall 14 includes drain holes 19 therein for providing drainage of water which might otherwise collect in the tray during shipping. As shown in the drawings, the rounded body portion may be formed of arcuate side wall structure portions interposed between straight side wall structure portions.

A plurality of spaced step like protrusions 26 are provided on the side wall 16 which extend radially inwardly from the inner surface 22 of the side walls 16. The protrusions 26 are formed in sidewall 16 such that corresponding radially inwardly extending indentations 28 are formed in the outer surface 24 of the side wall 16. The side wall 16 extends above the protrusions 26 at flange 30.

The plurality of radially inwardly extending protrusions 26 have upper surfaces 32. The plurality of upper surfaces 32 are co-planar. The protrusions 26 include a generally vertical radially inward side 34 and a pair of opposed sides 36,38 which are slanted outward such that each protrusion is wider at the lower end thereof than at the upper end thereof.

A central hub portion 40 extends upwardly from the upper surface 18 of the bottom wall 14. The hub includes a plurality of radially outwardly extending hub protrusions 42. Preferably, three circumferentially equally spaced hub protrusions 42 are provided in the present invention. The hub protrusions are connected by arcuate upstanding walls 44. The hub protrusions are narrow at the radially inner end and widen to the radially outermost end.

Each of the hub protrusions 42 have slanted side walls 46 and 48 which provide for widening of the hub protrusion at the portion close to the bottom wall. Additionally, the radially outermost surfaces 50 also slant radially outwardly such that the lower portions of the hub define a greater area than the upper portions of the hub. The walls 44 are also similarly slanted in a radially outward direction as they proceed in a downward direction toward the bottom wall 14. The radially outwardly extending protrusions include a locking bead 45 at the upper end of walls 44 which bead extends generally horizontally and radially outwardly.

Referring to FIG. 2 the hub portion 40 is hollow and opens to the lower surface 20 of the bottom wall 14. The hollow underside of the hub 40 provides radially outwardly extending indentations 50 formed therein which correspond to the radially outwardly extending protrusions 42 on the upstanding portion of the hub. The outwardly extending indentations are connected by horizontally extending walls 51 therebetween.

As will be noted in FIG. 5, on inset portion 52 is provided which raises the hub protrusion up from the bottom wall 14. The walls 51 extend horizontally from the inset portion 52 to interconnect with the center of central hub portion 40 and adjacent indentations 50. The walls 51 are spaced upwardly from the bottom wall 14 by the inset portion 52. The inset portion includes a circumferential radially inward extending locking rib 53 which interacts with the locking bead 45 when the trays are in stacked position to help hold the trays vertically together during packing and shipping.

At least three of the protrusions 26 include a second outwardly stepped portion 54. In a the preferred embodiment four outwardly stepped portions 54 are provided in the present invention. As disclosed below, the outwardly stepped portions 54 act as stops during nesting of the trays for storage and transportation such that the trays may be easily separated for reuse. The tray 10 also includes a plurality of upwardly extending rib portions 56 on the upper surface of the outwardly extending protrusions 26, preferably four upwardly extending ribs 56 are provided in the construction of the present invention at the arcuate sections of the side wall 16. A corresponding plurality of grooves 58 formed in the bottom wall are provided such that when the trays are successively stacked one upon another the upstanding ribs 56 will engage the grooves 58 to provide for securement against rotation between stacked trays.

An indicia means 60 is provided in the form of a colored stripe which laterally extends from one side of the tray to the other and is visible from the outer side 24 of the side wall 16. In the preferred embodiment of the present invention the tray is formed of a thermoformed high density polyethylene virgin black allied BA-50-100 or its equivalent and the stripe 60 is either molded in-situ with a contrasting green material or could be applied as a green adhesive tape or the like which extends from the overturned lip portion 62 of the side wall down the inside surface 22 of the side wall and across the upper surface of bottom wall 14 to proceed up the opposite side wall surface and over the lip portion 62.

In operation, weather stripping 64 is manufactured in discrete pieces of a single length or various lengths. The individual weather strip pieces are coiled in the tray from the radially outermost side wall 16 inwardly until they are adjacent to the hub portion 40. The weather stripping is vertically stacked to a point below the upper surface of the hub portion and below the plane of the surfaces 32 of the radially inwardly extending protrusions. The hub 40 acts as a stop to help retain the weather stripping in the coiled orientation thereby reducing the possibility of damage to the weather stripping due to lateral movement during shipping.

Thus, the shipping tray of the present invention allows weather stripping to be securely held in the coiled position without kinking or bending upon itself as was common in prior art shipping containers and which kinking caused damage to the bulb portion of the weather stripping.

Referring now to FIGS. 4 and 5, the tray 10 of the present invention is stackable with a tray of like configuration in a first position.

In the stacked position the portions of the bottom wall between the radially inwardly extending protrusions 26 rest on the upper surfaces 32 of the step-like inwardly extending protrusions 26 of the tray of like configuration. Likewise the walls 51 formed between the indentations of the hollow side of the hub rest on the upper most surfaces of the outwardly extending protrusions 42 of the tray of like configuration. The hub and the inwardly extending protrusions carry the weight load of the stacked trays. The hub acts as a loading column which distributes the weight from one tray to another through the vertical length of the stacked trays and onto the pallet.

In a series of successively stacked trays in the first position, the indicia stripe 62 is visible at the side tray. The indicia are staggered when in the stacked position such that in every other tray the stripes are vertically aligned. Thus, proceeding through the stacked trays and referring to FIG. 4, the first stacked tray has the indicia on a first side, the second stacked tray has the indicia stripe staggered laterally on a second side, the third tray will have the indicia on the same position as the first tray and the fourth tray will have the indicia in the same position as the second tray. This pattern is continued throughout stacking of the trays.

Figure 6:
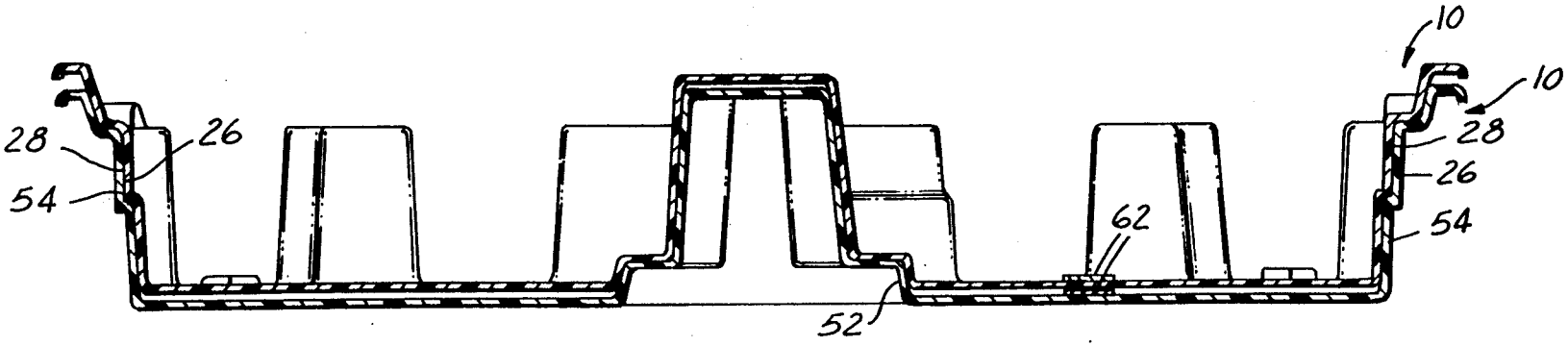
FIG. 6 is a sectional view taken along lines 6—6 of FIG. 1 showing a pair of trays made in accordance with the teachings of the present invention in the nested position.

Referring now to FIG. 6, an important advantage of the present invention that the trays are also nestable into trays of like configuration. The second nested position is accomplished by rotating the trays 180° from the stacked position such that the indicia stripes 62 line up vertically from one to another in the nested position wherein the stripes are vertically co-planar. In the second nesting position the plurality of radially inwardly extending protrusions 26 of one tray nest into the plurality of radially inwardly extending indentations 28 of the tray of like configuration. Correspondingly the radially outwardly extending hub protrusions of one of the trays aligns with the inner formed cavity of the hollow side of the hub of the other tray. As stated above, the stepped portions 54 of one tray act as stops such that the trays do not become jammed together which would make unnesting difficult.

In the nested position the tray of the present invention provides an advantageous three to one return ratio (3:1) i.e., three trays are contained in the nesting position in the space that one tray takes up during stacking of the trays. This allows for reduced costs in return shipping.

In operation, the trays are advantageously utilizable for shipping coiled weather stripping when in the stacked position. The operator or loaders who stack the trays may easily stagger the indicia stripes such that they alternate between one tray and another, as shown in FIG. 4, in order to indicate that the trays are in the stacked position.

Referring to FIG. 4, a pallet and lid combination 66 is provided for covering of the stacked trays during shipping. The pallet lid 66 also doubles as a pallet which the trays can be stacked upon. The pallet/lid 66 includes a series of weight bearing legs 68 which support the load of a series of stacked trays and includes spaces which allow a fork lift to pick up and move the stack of trays when used as a pallet tray.

Upon reaching the destination the weather stripping is removed for use and the trays may be easily placed in the nesting position by merely realigning the striped indicias from one tray to another (such that the stripes are co-planar) and placing the trays successively one on top of another.

While the above description constitutes the preferred embodiment of the present invention, it is to be appreciated that the invention is susceptible to modification, variation and change without departing from the proper scope and fair meaning of the accompanying claims.

I claim:

1. A tray for transporting coiled weather stripping comprising:

a generally rounded body portion, said body portion having a bottom wall and an upstanding continuous sidewall, said bottom wall including a top surface and a bottom surface, said sidewall having an inner surface and an outer surface, said sidewall including a plurality of spaced radially inwardly extending step-like protrusions on said inner surface of said sidewall and forming corresponding radially inwardly extending indentations in the outer surface of said sidewall, said sidewall extending vertically above said inwardly extending step-like protrusions, said inwardly extending protrusions including upper surfaces defining a co-planar surface; a central hub portion extending from said bottom wall in an upstanding direction and being hollow in cross-section and opening at said bottom surface of said tray, said central hub portion including a plurality of radially outwardly extending central hub portion protrusions, thereby providing in the hollow underside of said central hub portion a corresponding plurality of radially outwardly extending indentations having walls extending therebetween, said weather stripping being coiled about the central hub portion in the space between the central hub portion and the sidewall, said central hub portion acting as a stop to help retain the weather stripping in its coiled orientation to reduce the possibility of damage of said weather stripping due to lateral movement during shipping, said tray being stackable with a tray of like configuration in a first position wherein portions of said bottom wall between said inwardly extending protrusions of the inner surface of said tray rest on the upper surfaces of the plurality of step-like inwardly extending protrusions of said tray of like configuration and the walls extending between the outwardly extending indentations provided in the hollow underside of said central hub portion rest on the radially outwardly extending central hub portion protrusions of said tray of like configuration, wherein the weight contained in said tray is distributed in stacking between said central hub portion and said plurality of inwardly extending protrusions of said sidewall and is nestable with said tray of like configuration when rotated to a second position wherein said plurality of radially inwardly extending protrusions of the inner surface of said tray nests into the plurality of radially inwardly extending indentations of said outer surface of said tray of like configuration and said plurality of radially outwardly extending central hub portion protrusions nest into the plurality of radially outwardly extending indentations provided in the hollow underside of the central hub portion of said tray or like configuration.

2. The tray of claim 1 further comprising a visible indicia means for providing an indicia of alignment of said tray in said first or second positions, said indicia being visible from the outer side of said tray, wherein said indicia is vertically aligned on like trays when the like trays are nested in said second position and are vertically staggered from one tray to another when the like trays are stacked in the first position.

3. The tray of claim 1 wherein at least three of said inwardly extending projections include an inwardly extending step portion for limiting nesting of like trays to a predetermined extent for reducing possibility of jamming of the trays in the nested position.

4. The tray of claim 1 further comprising a plurality of upwardly and radially extending ribs on said upper surfaces of said radially inwardly extending protrusions spaced about the periphery of said sidewall and a corresponding number of grooves formed in the bottom wall of said tray, said radially extending ribs of the tray engaging the grooves of said tray of like configuration when stacked in said first position for securing the trays against lateral or rotational movement.

5. The tray of claim 1 wherein said central hub portion further comprises an inset portion at the bottom thereof, said inset portion including a radially inwardly extending locking rib at the peripheral edge thereof and said radially outwardly extending central hub portion protrusions include an outwardly extending locking bead, whereby when said tray is stacked with said tray of like configuration said locking bead of said radially outwardly extending central hub portion protrusions locks in said inset portion by overlapping of said radially inwardly extending locking rib.

6. The tray of claim 1 wherein said sidewall includes arcuate sidewall structure portions interposed between straight sidewall structure portions for forming said rounded body shape.

* * * * *